US007954807B2

(12) United States Patent
Yamaguchi

(10) Patent No.: US 7,954,807 B2
(45) Date of Patent: Jun. 7, 2011

(54) SHEET-FEEDING DEVICE AND IMAGE FORMING APPARATUS PROVIDED WITH THE SAME

(75) Inventor: Yoshihiro Yamaguchi, Osaka (JP)

(73) Assignee: Kyocera Mita Corporation (JP)

( * ) Notice: Subject to any disclaimer, the term of this patent is extended or adjusted under 35 U.S.C. 154(b) by 266 days.

(21) Appl. No.: 12/141,957

(22) Filed: Jun. 19, 2008

(65) Prior Publication Data

US 2009/0001657 A1 Jan. 1, 2009

(30) Foreign Application Priority Data

Jun. 26, 2007 (JP) ..... 2007-167113

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS

| | | | | |
|---|---|---|---|---|
| 5,145,164 | A * | 9/1992 | Kan | 271/170 |
| 5,988,621 | A * | 11/1999 | Kondo et al. | 271/3.02 |
| 2005/0275155 | A1* | 12/2005 | Horiba | 271/145 |
| 2006/0113724 | A1* | 6/2006 | Ito et al. | 271/162 |

FOREIGN PATENT DOCUMENTS

JP 2001-213528 8/2001

* cited by examiner

*Primary Examiner* — Michael C McCullough
(74) *Attorney, Agent, or Firm* — Gerald E. Hespos; Michael J. Porco

(57) ABSTRACT

A sheet-feeding device includes a sheet-feeding cassette with a sheet holding surface for holding a sheet. A side wall extends up from the sheet holding surface. A sheet-restricting plate is in the cassette on a downstream side in the sheet-feeding direction for setting a position of the sheet in a width direction perpendicular to the sheet-feeding direction. A cassette accommodating section accommodates the sheet-feeding cassette drawably in a direction parallel to the sheet-feeding direction. A projection is on an upstream side in the sheet-feeding direction from the position of the sheet-restricting plate. The projection is formed by partially projecting the side wall of the cassette upward. A height of the projection exceeds a maximum height of a sheet stack that can be accommodated in the cassette, and a height of parts of the side wall other than the projection is lower than the maximum height of the sheet stack.

17 Claims, 6 Drawing Sheets

SHEET-FEEDING DEVICE AND IMAGE FORMING APPARATUS PROVIDED WITH THE SAME

BACKGROUND OF THE INVENTION

1. Field of the Invention

The present invention relates to a sheet-feeding device for feeding sheets such as cut paper, and an image forming apparatus provided with the sheet-feeding device.

2. Description of the Related Art

In typical image forming apparatuses such as a copying machine, a printer, and the like, a sheet-feeding device is necessary for feeding sheets such as cut paper. In many of sheet-feeding devices provided in image forming apparatuses, a large number of sheets to be printed are stocked in advance in a sheet-accommodating section such as a sheet-feeding cassette and a sheet-feeding tray, and the sheets stacked in the sheet-accommodating section are separated and fed one after another from an uppermost layer of the sheets. Such sheet-feeding device is adopted in a sheet-feeding section of a cassette type, a manual sheet-feeding section, a document feeding section, and the like, each of which is provided in an image forming apparatus.

In some cases, a sheet-accommodating section, such as a sheet-feeding cassette and a sheet-feeding tray, provided in a sheet-feeding device includes a sheet-restricting plate. The sheet-restricting plate is movable along a rail provided on a bottom surface of a sheet-feeding cassette and comes in contact with a side surface of a sheet stack provided in the sheet-feeding cassette, so that positions of the sheets are set. Accordingly, the sheets do not move from predetermined positions, so that a stable sheet-feeding can be performed.

Further, a sheet-feeding cassette and a sheet-feeding tray are generally provided in its periphery with side walls which extend vertically upward at such positions as to surround the accommodated sheets. An example of such sheet-feeding device is described in Japanese Patent Unexamined Publication No. 2001-213528 (Page 4, FIG. 6).

The sheet-feeding cassette disclosed in the patent document mentioned above is provided with side walls having a height which is higher than a height of an uppermost layer of a sheet stack full of sheets, in other words, a sheet stack including a maximum number of sheets which can be accommodated in the sheet-feeding cassette. However, according to this configuration, when the sheet-feeding cassette is accommodated into the accommodating section, the side walls in periphery of the sheet-feeding cassette may come in contact with a slide mechanism, which is adapted to allow the sheet-feeding cassette to be freely drawn out from and accommodated into the cassette accommodating section, a sheet-feeding roller, which is adapted to send the sheets from the sheet-feeding cassette to outside, and the like, so that it becomes likely that these members are broken.

On the other hand, for the purpose of avoiding such problem as described above, a method of making a height of the side walls in periphery of the sheet-feeding cassette to be lower than a height of an uppermost layer of a sheet stack including a maximum number of sheets. For example, the height of the walls is set to be half the height of the sheet stack including a maximum number of sheets. This can reduce the above-described trouble which is caused by that the side walls in periphery of the sheet-feeding cassette come in contact with functional members provided in periphery of the cassette accommodating section when the sheet-feeding cassette is accommodated into the cassette accommodating section.

However, according to this configuration, in a case where sheets which are relatively large in size in a sheet-feeding direction are accommodated in the sheet-feeding cassette, and a user exerts a great force to accommodate the sheet-feeding cassette into the cassette accommodating section, the sheet stack tends to move with an inertia force and overcome the restriction applied by the sheet-restricting plate. Accordingly, an upstream portion of the sheets in the sheet-feeding direction may be shifted in a sheet width direction drastically. As a result, an appropriate sheet-feeding cannot be performed, so that it becomes likely that displacement of a print image due to oblique movement of the sheet or a jam may occur.

SUMMARY OF THE INVENTION

An object of the present invention is to provide a sheet-feeding device capable of preventing a breakage of constituting members, and an image forming apparatus provided with the sheet-feeding cassette.

A sheet-feeding device according to an aspect of the present invention which achieves the object is a sheet-feeding cassette for feeding a sheet in a predetermined sheet-feeding direction. The sheet-feeding device includes: a sheet-feeding cassette including: a sheet holding surface for holding a sheet; and a side wall extending upward from the sheet holding surface; a sheet-restricting plate provided in the sheet-feeding cassette on a downstream side in the sheet-feeding direction for setting a position of the sheet in a sheet width direction which is perpendicular to the sheet-feeding direction; a cassette accommodating section for accommodating the sheet-feeding cassette drawably in a direction parallel to the sheet-feeding direction; and a projecting portion arranged on an upstream side in the sheet-feeding direction from the position where the sheet-restricting plate is arranged, the projecting portion being formed by partially projecting the side wall of the sheet-feeding cassette upward, a height of the projecting portion being higher than a maximum height of a sheet stack which can be accommodated in the sheet-feeding cassette, a height of parts of the side wall other than the projecting portion being lower than the maximum height of the sheet stack.

Further, an image forming apparatus according to another aspect of the present invention includes: an image forming section for performing an image forming processing with respect to a sheet; and a sheet-feeding device for feeding the sheet to the image forming section. The sheet-feeding device has the configuration described above.

These and other objects, features and advantages of the present invention will become more apparent upon reading of the following detailed description along with the accompanied drawings.

DETAILED DESCRIPTION OF THE PREFERRED EMBODIMENTS

Hereinafter, an embodiment of the present invention will be described in detail with reference to the drawings.

Figure 1:
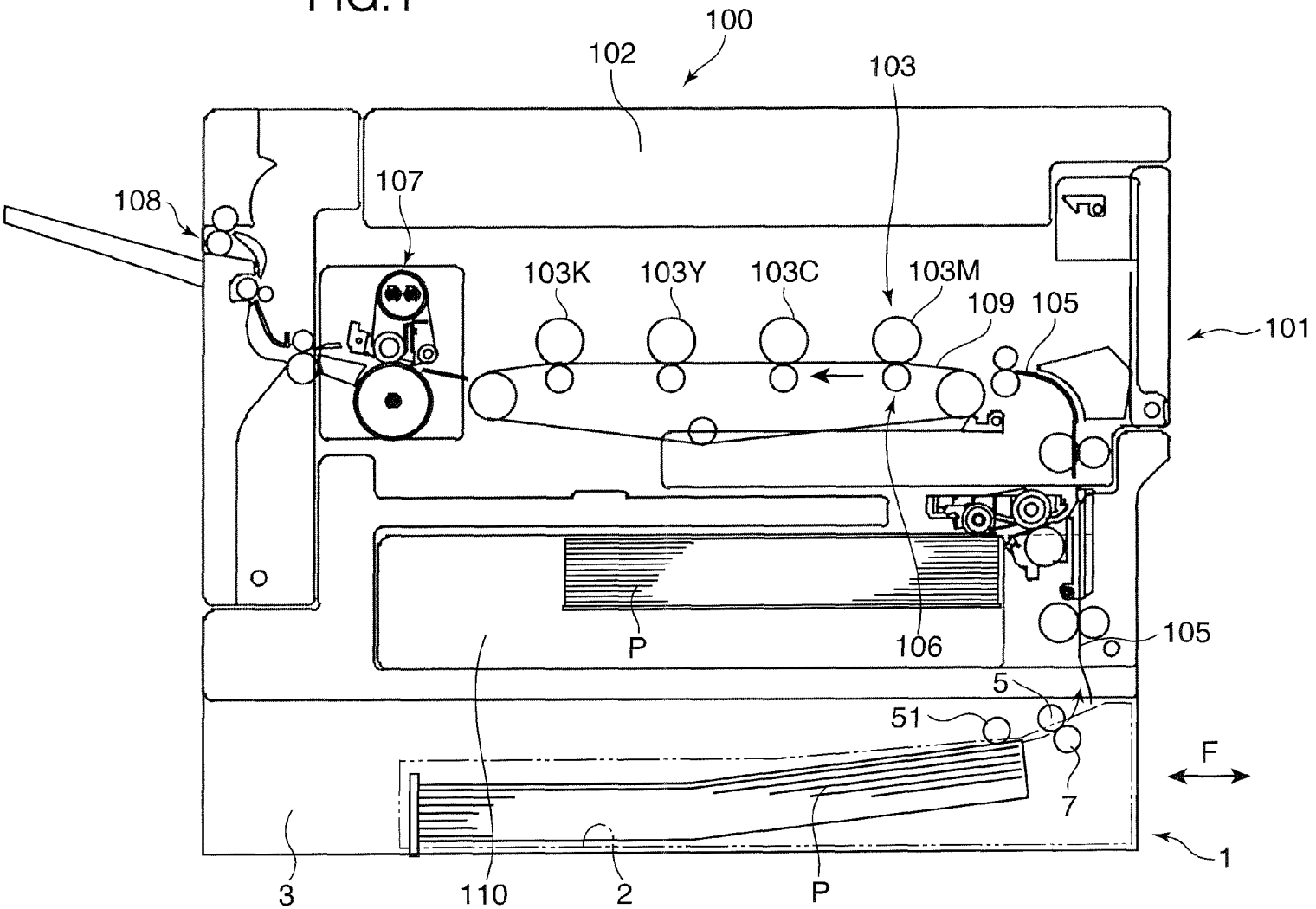
FIG. 1 schematically shows an internal structure of an image forming apparatus in accordance with an embodiment of the present invention.

FIG. 1 is a front sectional view showing an internal structure of an image forming apparatus 100 provided with a sheet-feeding device 1 in accordance with an embodiment of the present invention. The image forming apparatus 100 is a copying machine and includes an apparatus main body 101 and an optional sheet-feeding device (sheet-feeding device 1) arranged in a lower portion of the apparatus main body 101.

The apparatus main body 101 includes a scanner portion 102, an image forming section 103, a fixing section 107, and a sheet-feeding section 110. The scanner section 102 optically reads a document image to generate electric document image data. The image forming section 103 is adapted to form a color image and includes a conveying belt 109 which is rotatable in a direction of an arrow shown in the drawing, and a magenta unit 103M, a cyan unit 103C, a yellow unit 103Y, and a black unit 103K which are arranged from an upstream side (right side) to a downstream side along the rotational direction of the conveying belt 109.

Each of the units 103M, 103C, 103Y, and 103K includes a photoconductive drum having a peripheral surface onto which an electrostatic latent image and a toner image are formed in accordance with the document image data, a charging device for uniformly charging the peripheral surface of the photoconductive drum, a developing device for developing the electrostatic latent image, and a cleaning device for cleaning the peripheral surface of the photoconductive drum. Corresponding respectively to the units 103M, 103C, 103Y, and 103K, there are provided transferring section 106 for transferring the toner images of respective colors onto a sheet P.

The fixing section 107 includes a fixing roller and a pressing roller which comes in pressed contact with the fixing roller to form a nip portion. The color toner image transferred to the sheet P is fixed on the sheet P in the fixing section 107. The sheet-feeding section 110 is a feeding device provided as a standard equipment in the apparatus main body 101 and stores a sheet stack including a large number of layered sheets P. The sheet-feeding device 1 is a sheet-feeding device which is mounted to the apparatus main body 101 optionally when a user desires the same. The sheet-feeding device 1 similarly stores a sheet stack.

The sheet P stored in the sheet-feeding device 1 or the sheet-feeding section 110 is conveyed into the image forming section 103 through the sheet conveying passage 105. Thereafter, the sheet P is conveyed on the conveying belt 109, and toner images of magenta, cyan, yellow, and black are sequentially transferred to the sheet P at respective transferring sections 106 of the units 103M, 103C, 103Y, and 103K. After the sheet P enters the fixing section 107 and is applied with a fixing processing of fixing a color toner image, the sheet P is discharged from the sheet discharging section 108 to outside.

Figure 2:
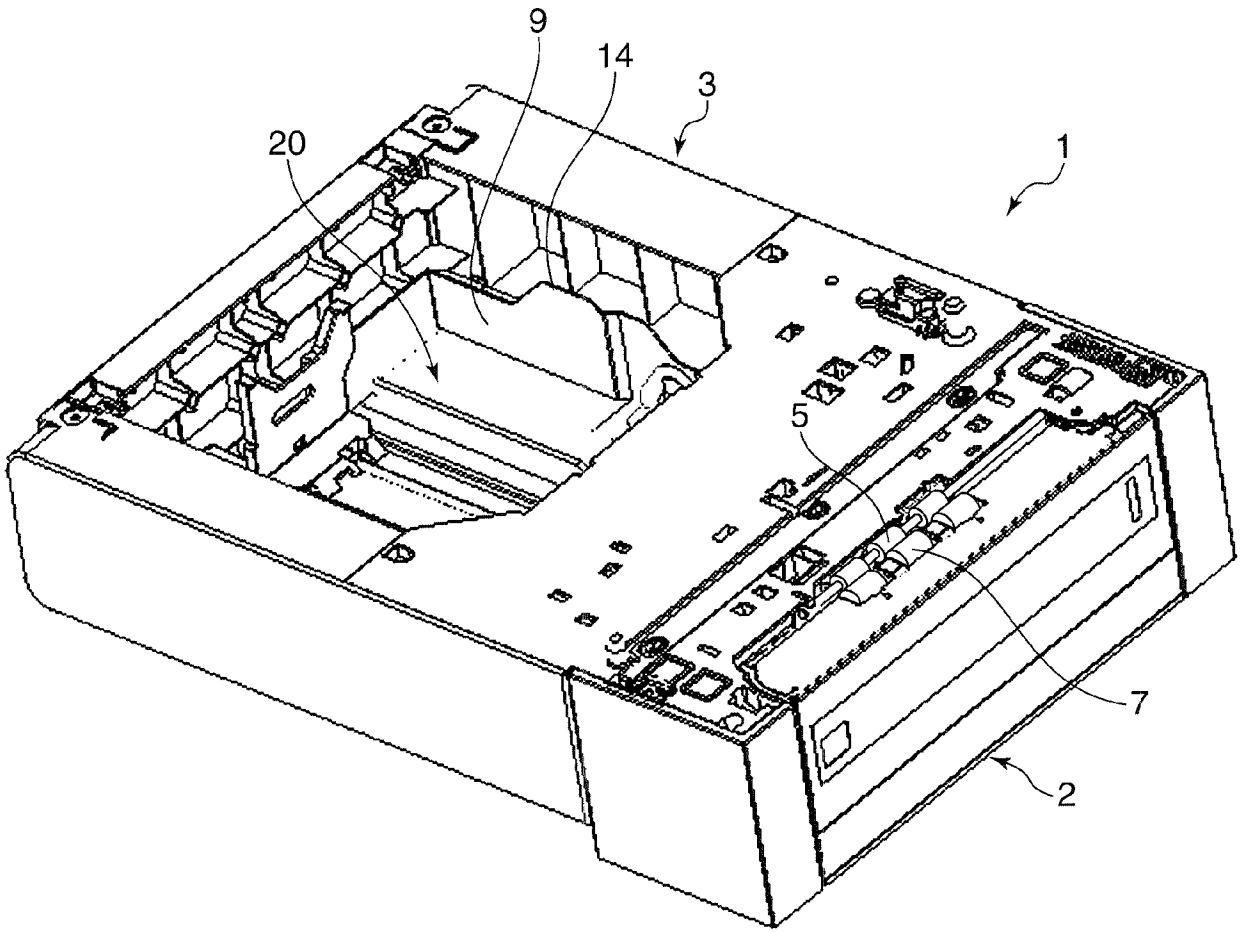
FIG. 2 is an overall perspective view showing a sheet-feeding device in accordance with an embodiment of the present invention.
Figure 3:
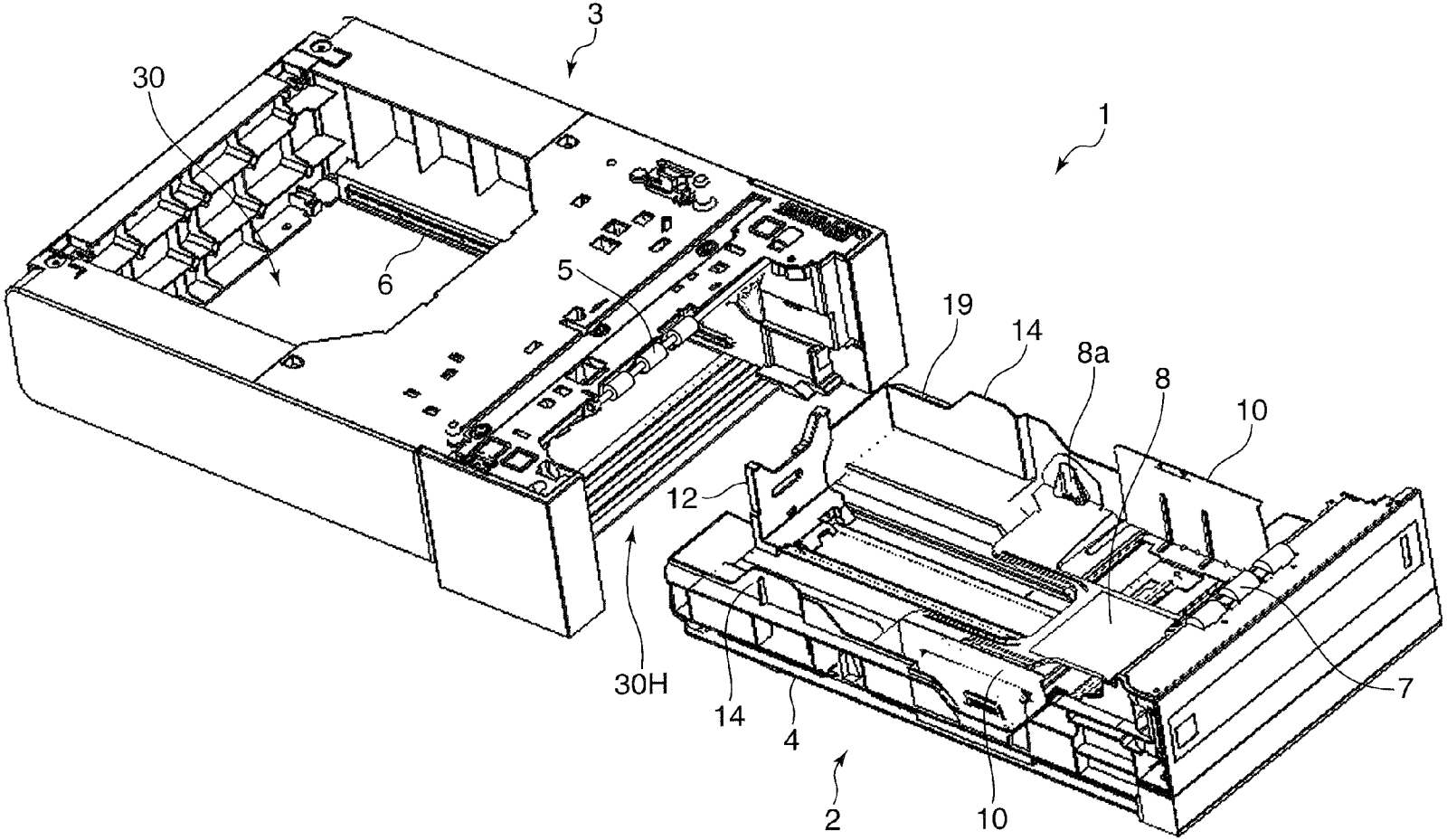
FIG. 3 is an overall perspective view of the sheet-feeding device and shows a state where a sheet-feeding cassette is drawn out.
Figure 4:
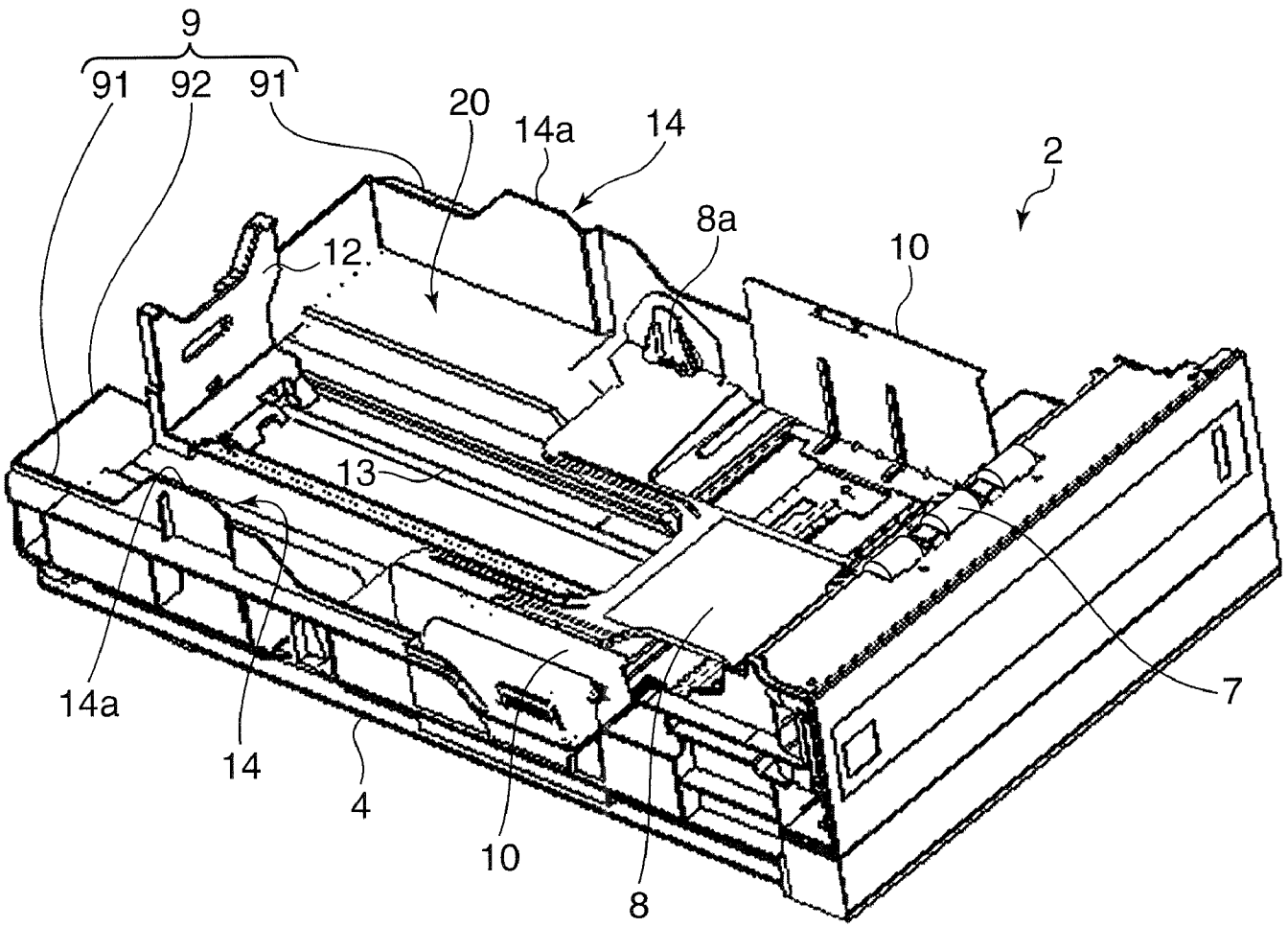
FIG. 4 is a perspective view of the sheet-feeding cassette.

Next, a structure of the sheet-feeding device 1 will be described with reference to FIGS. 2-4. FIG. 2 is an overall perspective view of the sheet-feeding device 1 viewed from above. FIG. 3 is also a perspective view of the sheet-feeding device 1 and shows a state where the sheet-feeding cassette 2 is drawn out. FIG. 4 is a perspective view of the sheet-feeding cassette 2. In FIGS. 2-4, a right side corresponds to a front side of the sheet-feeding device, and a left side corresponds to a rear side.

The sheet-feeding device 1 includes a sheet-feeding cassette 2 and a cassette accommodating section 3 for accommodating the sheet-feeding cassette 2. The cassette accommodating section 3 includes a frame member having a rigidity for supporting the apparatus main body 101. The sheet-feeding cassette 2 slides in a direction indicated by an arrow F shown in FIG. 1, so that it can be mounted to the cassette accommodating section 3 or drawn out from the cassette accommodating section 3.

As shown in FIG. 4, the sheet-feeding cassette 2 has a flat box-like shape having an open upper side. A large number (stack) of sheets such as cut paper are stacked and accommodated in the sheet-feeding cassette 2. The sheet-feeding cassette 2 includes a sheet-holding surface 20 for holding the sheet stack and side walls 9 extending upward from the sheet holding surface 20. Further, on left and right side surfaces in an outer side of the sheet-feeding cassette 2, there are provided guide rails 4 extending substantially horizontally in forward and rearward directions of the sheet-feeding device 1.

As shown in FIG. 3, the cassette accommodating section 3 has a cavity 30 extending from the front side to the rear side of the sheet-feeding device 1, and an opening 30H is formed in the front side so that the sheet-feeding cassette 2 can be drawn out and inserted. In an upper portion of the front side of the cassette accommodating section 3, a sheet-feeding roller 5 is provided for taking out the sheets accommodated in the sheet-feeding cassette 2 to outside of the sheet-feeding device 1.

On a rear side of the sheet-feeding roller 5, a pickup roller 51 (refer to FIG. 1) is provided which comes in contact with an uppermost layer of the sheets stacked on the sheet holding surface 20 to send out the sheets to the sheet-feeding roller 5. The sheet-feeding roller 5 and the pickup roller 51 are connected to unillustrated motor and driving mechanism and rotated in the same direction at the same speed.

On the left and right side surfaces inside the cassette accommodating section 3, there are provided horizontal projections 6 so shaped as to extend substantially horizontally in forward and rearward directions of the sheet-feeding device 1. The horizontal projections 6 are provided at portions corresponding to the guide rails 4 of the sheet-feeding cassette 2. The guide rails 4 of the sheet-feeding cassette 2 are engaged with the horizontal projections 6 of the cassette accommodating section 3, so that the sheet-feeding cassette 2 can be drawn out from or accommodated into the sheet-feeding device 1 substantially horizontally, in other words, in leftward and rightward directions in FIG. 3.

Figure 5:
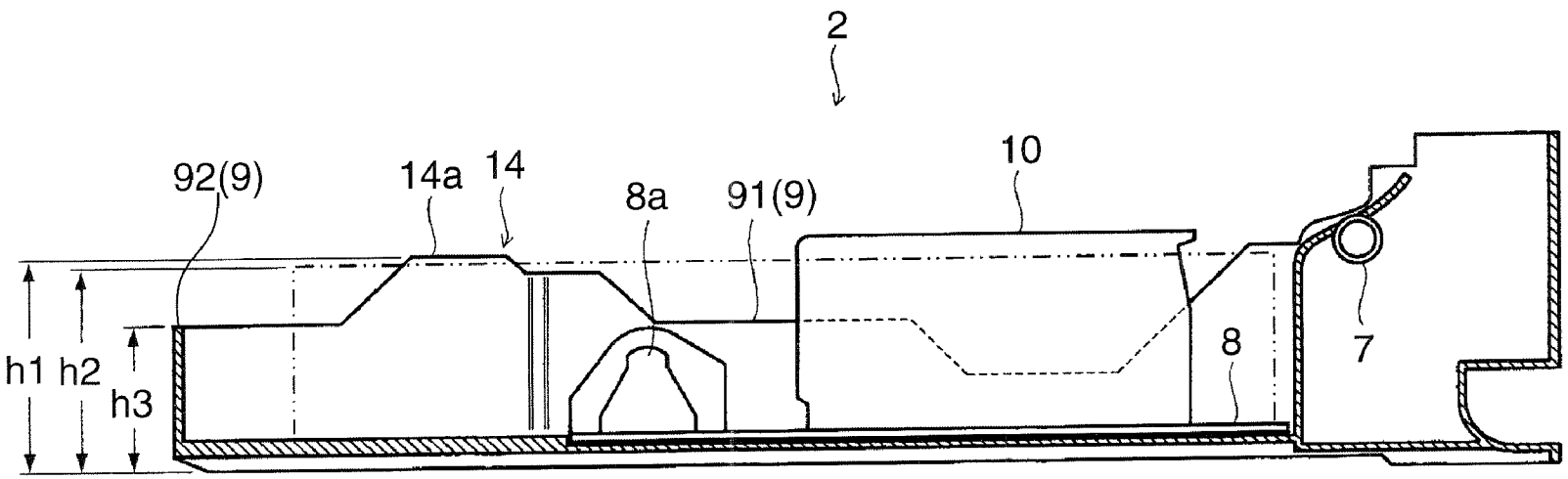
FIG. 5 is a vertical cross sectional view of the sheet-feeding cassette shown in FIG. 4 viewed from a left side.
Figure 6:
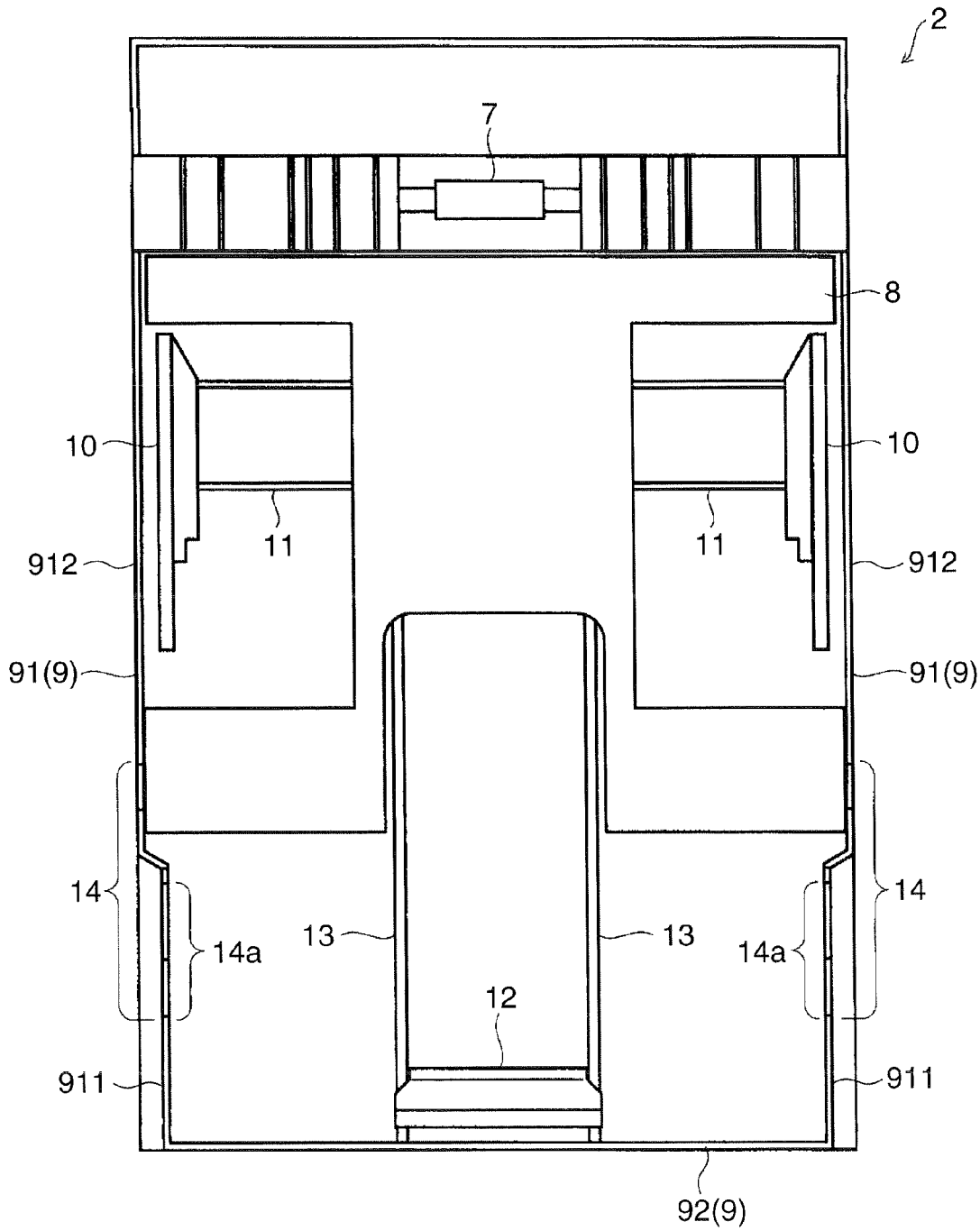
FIG. 6 is a top view of the sheet-feeding cassette shown in FIG. 4.

Next, a detailed configuration of the sheet-feeding cassette 2 will be described with reference to FIGS. 5 and 6 in addition to FIGS. 2-4. FIG. 5 is a left side sectional view of the sheet-feeding cassette 2. FIG. 6 is a top view of the sheet-feeding cassette 2.

The sheet-feeding cassette 2 has a flat box-like shape having an open upper side as described above. The sheets are supplied from an upper side and accommodated into the sheet-feeding cassette 2. In FIG. 5, an area of a sheet stack having a maximum height (hereinafter, referred to as "sheet stack including a maximum number of sheets") which can be accommodated in the sheet-feeding cassette 2 is surrounded by two-dotted chain lines. The sheet-feeding cassette 2 includes a separating roller 7, a sheet lifting plate 8 (a part of the sheet holding surface 20), side walls 9, widthwise sheet-restricting plates 10, a lengthwise sheet-restricting plate 12, and projecting portions 14.

The separating roller 7 is provided in an upper portion of the front side of the sheet-feeding cassette 2. As shown in FIG. 2, the separating roller 7 comes in contact with the sheet-feeding roller 5, which is provided in an upper portion of the front side of the cassette accommodating section 3, in a state where the sheet-feeding cassette 2 is accommodated in the cassette accommodating section 3. The sheet sent out by the pickup roller 51 passes through a nip portion formed between the separating roller 7 and the sheet-feeding roller 5 in contact with each other. A motor is not connected to the separating roller 7. The separating roller 7 comes in contact with the sheet-feeding roller 5, so that it is rotated by rotation of the sheet-feeding roller 5.

On a rotational shaft of the separating roller 7, there is provided an unillustrated torque limiter. When there is no sheet at the nip portion which is formed by a pressed contact between the separating roller 7 and the sheet-feeding roller 5, or when only one sheet enters the nip portion, a torque which is equal to or greater than a set torque of the torque limiter is exerted to the separating roller 7. Therefore, the separating roller 7 is rotated by the sheet-feeding roller 5 in a direction of sending out the sheet. However, when a plurality of sheets enter the nip portion in a stacked state, the torque exerted to the separating roller 7 does not become greater than the set torque of the torque limiter, so that the separating roller 7 stops its rotation. Accordingly, since a sheet on a lower side of the stacked sheets is not sent out, it can prevent the sheets from being sent out in a stacked state.

In the sheet-feeding device 1, the sheet-feeding roller 5 and the separating roller 7, like the ones described above, separate the sheets one after another from an uppermost layer of the sheets stacked in the sheet-feeding cassette 2 and feed the sheets from the left side toward the right side in FIGS. 4 and 5. Here, the sheet-feeding cassette 2 is drawn out from or accommodated into the cassette accommodating section 3 in a direction parallel to the sheet-feeding direction.

The sheet lifting plate 8 is provided on a bottom surface side of the sheet-feeding cassette 2. The sheets are placed on an upper surface of the sheet lifting plate 8. The sheet lifting plate 8 includes a supporting portion 8*a* at an upstream end in the sheet-feeding direction, in other words, at an end portion on the left side in FIG. 5. The sheet lifting plate 8 is supported by the supporting portion 8*a* inside the sheet-feeding cassette 2 at the side walls 9 on opposite sides in a sheet-width direction being perpendicular to the sheet-feeding direction. The sheet lifting plate 8 is rotatable about the supporting portion 8*a* in a vertical plane at a downstream end as a free end.

A downstream end portion of the sheet lifting plate 8 is shifted upward by an unillustrated driving apparatus. In other words, a downstream end portion of the sheet lifting plate 8 is lifted upward by the driving apparatus, so that an uppermost layer of the sheet stack is shifted to a sheet-feeding position at which the uppermost layer comes in contact with the pickup roller 51 (refer to FIG. 1) provided in the cassette accommodating section 3.

The widthwise sheet-restricting plate 10 is provided in the sheet-feeding cassette 2 at a downstream portion in the sheet-feeding direction. There are provided two widthwise sheet-restricting plates 10. The widthwise sheet-restricting plates 10 come in contact with side surfaces of the sheet stack from opposite sides in the sheet width direction to set a position of the sheets in the sheet width direction. As shown in FIG. 6, the widthwise sheet-restricting plates 10 can be shifted along rails 11 provided on the bottom surface of the sheet-feeding cassette 2 in the sheet width direction.

Under the two widthwise sheet-restricting plates 10, there is provided an unillustrated interlocking mechanism (rack and pinion). The interlocking mechanism includes racks provided respectively to the two widthwise sheet-restricting plates 10 and a pinion mounted on the bottom surface of the sheet-feeding cassette 2. By the interlocking mechanism, when one of the widthwise sheet-restricting plates 10 is shifted, the other is also shifted concurrently. At this time, the two widthwise sheet-restricting plates 10 move symmetrically about a center line in the sheet width direction.

The lengthwise sheet-restricting plate 12 is provided in the sheet-feeding cassette 2 at an upstream portion in the sheet-feeding direction. One lengthwise sheet-restricting plate 12 is provided and comes in contact with a side surface of the sheet stack from an upstream side to set a position of the sheets in the sheet-feeding direction. The lengthwise sheet-restricting plate 12 can be shifted along rails 13 provided on an inner bottom surface of the sheet-feeding cassette 2 in the sheet-feeding direction. In FIG. 5, for convenience in describing a detailed configuration of the side walls 9 which will be described hereinafter, depiction of the lengthwise sheet-restricting plate 12 is omitted.

The side walls 9 are provided vertically upward from the bottom surface (sheet holding surface 20) at such positions as to surround the sheets accommodated in the sheet-feeding cassette 2. The side walls 9 include a pair of first side walls 91 being parallel to the sheet-feeding direction and opposing each other at a predetermined clearance, and a second side wall 92 positioned at an upstream end in the sheet-feeding direction. The first side walls 91 oppose respectively to the side end portions in the widthwise direction of the sheet stack, and the second side wall 92 opposes a rear end portion in the lengthwise direction of the sheet stack.

As shown in FIGS. 4 and 5, each of the first side walls 91 is provided with a projecting portion 14 on an upstream side in the sheet-feeding direction from the position where the widthwise sheet-restricting plate 10 is provided. The projecting portion 14 has a trapezoidal shape projecting upward from the first side wall 91 partially. As shown in FIG. 5, a height h1 of each projecting portion 14 (upstream portion 14*a*) is higher than a height h2 of an uppermost layer of the sheet stack including a maximum number of sheets which can be accommodated in the sheet-feeding cassette 2.

On the other hand, a height h3 of parts, which are other than the projecting portions 14, constituting a majority of the side walls 9 is lower than the height h2 of an upper most layer of the sheet stack including a maximum number of sheets. In other words, an overall height of the second side wall 92 and a height of the parts of the first side wall 91 excluding the projecting portion 14 is lower than a height of an uppermost layer of the sheet stack including a maximum number of sheets.

As shown in FIGS. 4 and 6, in each projecting portion 14, the upstream portion 14*a* (a part of the projecting portion) in the sheet-feeding direction is positioned more inwardly in the sheet width direction than the first side wall 91 positioned on the downstream side in the sheet-feeding direction of the projecting portion 14. A first portion 911 positioned on the upstream side in the sheet-feeding direction of the first side wall 91 and extending from the upstream portion 14*a* is also positioned more inwardly in the sheet width direction with respect to a portion 912 (second portion) on a downstream side of the projecting portion 14 of the first side wall 91.

As described above, the sheet-feeding device 1 in accordance with the present embodiment includes the sheet-feeding cassette 2, the widthwise sheet-restricting plates 10 for setting a position of the sheets in the sheet width direction, and the cassette accommodating section 3 for accommodating the sheet-feeding cassette 2, and the sheet-feeding cassette 2 is drawn out from and accommodated into the cassette accommodating section 3 in a direction parallel to the sheet-feeding direction. On an upstream side in the sheet-feeding direction further than the position of the widthwise sheet-restricting plates 10, there are provided the projecting portions 14 projecting upward partially from the first side walls 91 opposing each other at opposite ends in the sheet width direction of the sheet-feeding cassette 2.

The height h1 of each projecting portion 14 is higher than the height h2 of the uppermost layer of the sheet stack including a maximum number of sheets which can be accommodated in the sheet-feeding cassette 2, and the height h3 of parts other than the projecting portions 14 of the side walls 9 in periphery of the sheet-feeding cassette 2 is lower than the height h2 of the uppermost layer of the sheet stack including a maximum number of sheets. Therefore, the side walls 9 excluding the parts of the projecting portions 14 are prevented from coming in contact with the cassette accommodating section 3. Further, the projecting portions 14 prevent unintended drastic shifting of the sheets in the sheet width direction on an upstream portion in the sheet-feeding direction, so that an oblique movement of the sheets can be prevented.

Thus, a breakage of functional members such as the sheet-feeding roller 5 in periphery of the cassette accommodating section 3, which may likely to occur when the sheet-feeding cassette 2 is accommodated into the cassette accommodating section 3 and collide with the side wall, can be reduced. Further, the sheet-feeding device 1 can be provided which can prevent a displacement of a print image and a jam even in a case where sheet having a relatively large size is accommodated into the sheet-feeding cassette 2, and the sheets can be retained at an appropriate sheet position.

Further, at least a part (upstream portion 14*a*) of the projecting portions 14 are positioned more inwardly in the sheet width direction with respect to the first side walls 91 positioned on a downstream side in the sheet-feeding direction of the projecting portion 14. Accordingly, in a case where sheet having a relatively large size is accommodated into the sheet-feeding cassette 2, the side surface of the projecting portion 14 can come in contact with the sheets. Accordingly, shifting of the sheets in the sheet width direction at an upstream portion of the sheet-feeding cassette 2 in the sheet feeding direction can be prevented assuredly. Thus, an effect of restricting the sheets at an appropriate sheet position may be improved, so that more favorable sheet feeding can be performed.

Further, since each projecting portion 14 has a trapezoidal shape having a lower side which is shorter than an upper side, the strength of the projecting portion 14 is relatively high. Further, since the projecting portion 14 has a trapezoidal shape, the projecting portion 14 has an inclined surface inclining in a direction of mounting and dismounting the sheet-feeding cassette 2. Accordingly, there is an advantage that the sheet-feeding cassette 2 can be easily mounted or dismounted with respect to the cassette accommodating section 3.

As described above, in the present embodiment, an example in which the sheet-feeding device 1 is adopted as a sheet-feeding device for the image forming apparatus 100. However, this is a mere example. The present invention may be adopted in various apparatuses provided with a sheet-feeding cassette which can be drawn out from and accommodated in a direction parallel to a sheet-feeding direction.

The above-described embodiment mainly includes the invention having the following configurations.

A sheet-feeding device according to an aspect of the present invention includes: a sheet-feeding cassette including: a sheet holding surface for holding a sheet; and a side wall extending upward from the sheet holding surface; a sheet-restricting plate provided in the sheet-feeding cassette on a downstream side in the sheet-feeding direction for setting a position of the sheet in a sheet width direction which is perpendicular to the sheet-feeding direction; a cassette accommodating section for accommodating the sheet-feeding cassette drawably in a direction parallel to the sheet-feeding direction; and a projecting portion arranged on an upstream side in the sheet-feeding direction from the position where the sheet-restricting plate is arranged, the projecting portion being formed by partially projecting the side wall of the sheet-feeding cassette upward, a height of the projecting portion being higher than a maximum height of a sheet stack which can be accommodated in the sheet-feeding cassette, a height of parts of the side wall other than the projecting portion being lower than the maximum height of the sheet stack.

Further, an image forming apparatus according to another aspect of the present invention includes: an image forming section for performing an image forming processing with respect to a sheet; and a sheet-feeding device for feeding the sheet to the image forming section. The sheet-feeding device has the configuration described above.

According to the sheet-feeding device and the image forming apparatus, side walls of the sheet-feeding cassette other than the parts of the projecting portions can prevent a contact with respect to functional parts of the cassette accommodating section. Further, the projecting portions prevent unintentional drastic shifting of sheets in the sheet width direction at an upstream portion in the sheet-feeding direction, so that an oblique movement of the sheets can be prevented.

In the configuration above, it is preferable that at least a part of the projecting portion is positioned more inwardly in the sheet width direction than the side wall which is positioned on a downstream side in the sheet-feeding direction with respect to the projecting portion.

According to this configuration, in a case where sheets having a relatively large size are stored in the sheet-feeding cassette, the side surface of the projecting portion can come in contact with the side surface of the sheet stack. Accordingly, shifting of the sheets toward the sheet width direction at an upstream portion in the sheet-feeding direction of the sheet-feeding cassette can be prevented assuredly. Thus, an effect of restricting the sheets at an appropriate sheet position is improved, so that more favorable sheet-feeding can be performed.

In the configuration above, it is preferable that the side wall includes: a pair of first side walls being parallel to the sheet-feeding direction and opposing each other at a predetermined clearance; and a second side wall positioned at an upstream end in the sheet-feeding direction, and the projecting portion is provided on each of the pair of first side walls.

According to this configuration, the first side walls and the second wall, other than the projecting portion, are prevented from coming in contact with the cassette accommodating section.

In the configuration above, it is preferable that each projecting portion has a trapezoidal shape projecting upward from the respective first side wall partially.

According to this configuration, since the projecting portion has a trapezoidal shape, the strength of the projecting portion becomes relatively high. Further, since the projecting portion has a sloped surface inclining in the mounting and dismounting direction of the sheet-feeding cassette, the sheet-feeding cassette can be easily mounted and dismounted.

In this case, it is preferable that the first side wall includes a first portion positioned on an upstream side in the sheet-feeding direction, and the first portion is positioned more inwardly in the sheet width direction than a second portion which is positioned on a downstream side in the sheet-feeding direction, and the projecting portion is provided in the first portion.

According to this configuration, in a case where the sheets having a relatively large size are accommodated in the sheet-feeding cassette, the side surface of the first portion can come in contact with the side surface of the sheet stack. Accordingly, shifting of the sheets in the sheet-feeding cassette toward the sheet feeding direction at an upstream portion in the sheet-feeding direction can be prevented assuredly.

This application is based on Japanese Patent application serial No. 2007-167113 filed in Japan Patent Office on Jun. 26, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet-feeding device for feeding a sheet in a predetermined sheet-feeding direction from a stack of sheets having a maximum height, the sheet-feeding device comprising:

a sheet-feeding cassette including:

a sheet holding surface for holding the stack of sheets; and a side wall extending upward from the sheet holding surface;

a sheet-restricting plate provided in the sheet-feeding cassette at a position on a downstream side in the sheet-feeding direction for setting a position of the sheet in a sheet width direction which is perpendicular to the sheet-feeding direction;

a cassette accommodating section for accommodating the sheet-feeding cassette drawably in a direction parallel to the sheet-feeding direction; and a projecting portion arranged on an upstream side in the sheet-feeding direction from the position where the sheet-restricting plate is arranged, the projecting portion being formed by partially projecting the side wall of the sheet-feeding cassette upward, a height of the projecting portion being higher than the maximum height of a sheet stack which can be accommodated in the sheet-feeding cassette, a height of parts of the side wall other than the projecting portion being lower than the maximum height of the sheet stack, the projecting portion being configured for preventing shifting of an upstream portion of the sheet in the sheet width direction.

2. The sheet-feeding device according to claim 1, wherein at least a part of the projecting portion is positioned more inwardly in the sheet width direction than the side wall which is positioned on a downstream side in the sheet-feeding direction with respect to the projecting portion.

3. The sheet-feeding device according to claim 1, wherein:

the side wall includes:

a pair of first side walls being parallel to the sheet-feeding direction and opposing each other at a predetermined clearance; and a second side wall positioned at an upstream end in the sheet-feeding direction, and the projecting portion is provided on each of the pair of first side walls.

4. The sheet-feeding device according to claim 3, wherein each projecting portion has a trapezoidal shape projecting upward from the respective first side wall partially.

5. The sheet-feeding device according to claim 4, wherein each of the first side walls includes a first portion positioned on an upstream side in the sheet-feeding direction, and the first portion is positioned more inwardly in the sheet width direction than a second portion which is positioned on a downstream side in the sheet-feeding direction, and the projecting portion is provided in the first portion.

6. The sheet-feeding device according to claim 1, wherein the sheet-restricting plate is movable in the sheet width direction for setting the position of the sheet in the sheet width direction.

7. The sheet-feeding device according to claim 1, wherein the sheet-restricting plate is a first sheet-restricting plate, the sheet-feeding device further comprising a second sheet-restricting plate opposed to the first sheet-restricting plate in the sheet width direction, the first and second sheet-restricting plates being movable in the sheet width direction for setting the position of the sheet in the sheet width direction.

8. The sheet-feeding device according to claim 7, wherein the first and second sheet restricting plates are disposed inwardly in the sheet width direction from portions of the side wall downstream of the projecting portion.

9. The sheet-feeding device according to claim 1, wherein the parts of the side wall other than the projecting portion include sections upstream and downstream from the projecting portion.

10. An image forming apparatus comprising:

an image forming section for performing an image forming process with respect to a sheet; and a sheet-feeding device for feeding the sheet to the image forming section, wherein the sheet-feeding device includes:

a sheet-feeding cassette including:

a sheet holding surface for holding a stack of sheets, the stack defining a height no greater than a maximum height ; and a side wall extending upward from the sheet holding surface;

a sheet-restricting plate provided in the sheet-feeding cassette at a position on a downstream side in the sheet-feeding direction for setting a position of the sheet in a sheet width direction which is perpendicular to the sheet-feeding direction;

a cassette accommodating section for accommodating the sheet-feeding cassette drawably in a direction parallel to the sheet-feeding direction; and a projecting portion arranged on an upstream side in the sheet-feeding direction from the position where the sheet-restricting plate is arranged, the projecting portion being formed by partially projecting the side wall of the sheet-feeding cassette upward, a height of the projecting portion being higher than the maximum height of the stack of sheets which can be accommodated in the sheet-feeding cassette, a height of parts of the side wall other than the projecting portion being lower than the maximum height of the stack of sheets, the projecting portion being configured for preventing shifting of an upstream portion of the sheet in the sheet width direction.

11. The image forming apparatus according to claim 10, wherein at least a part of the projecting portion is positioned more inwardly in the sheet width direction than the side wall which is positioned on a downstream side in the sheet-feeding direction with respect to the projecting portion.

12. The image forming apparatus according to claim 10, wherein the side wall includes:

a pair of first side walls being parallel to the sheet-feeding direction and opposing each other at a predetermined clearance; and a second side wall positioned at an upstream end in the sheet-feeding direction, and the projecting portion is provided on each of the pair of first side walls.

13. The image forming apparatus according to claim 12, wherein each projecting portion has a trapezoidal shape projecting upward from the respective first side wall partially.

14. The image forming apparatus according to claim 13, wherein each of the first side walls includes a first portion positioned on an upstream side in the sheet-feeding direction, and the first portion is positioned more inwardly in the sheet width direction than a second portion which is positioned on a downstream side in the sheet-feeding direction, and the projecting portion is provided in the first portion.

15. A sheet-feeding device for feeding sheets in a predetermined sheet-feeding direction from a stack of sheets having a maximum height, the sheet-feeding device comprising:

a cassette accommodating section having opposite front and rear ends spaced apart along the sheet-feeding direction, a cavity formed in the cassette accommodating section between the front and rear ends and an opening to the cavity being formed at the front end of the cassette accommodating section; and a sheet feeding cassette dimensioned for insertion along the sheet-feeding direction through the opening of the cassette accommodating section and into the cavity thereof, the sheet-feeding cassette including:

a sheet holding surface for holding the sheets, first and second sheet-restricting plates projecting up from the sheet holding surface at downstream positions in the sheet-feeding direction, the first and second sheet-restricting plates being opposed to one another in a sheet width direction that is perpendicular to the sheet-feeding direction and being movable toward and away from one another in the sheet width direction for setting a position of the sheets on the sheet holding surface, first and second side walls extending up from the sheet holding surface and being opposed to one another in the sheet width direction, the first and second side walls having downstream portions disposed outwardly of the first and second sheet restricting plates in the sheet width direction and upstream portions upstream of the sheet-restricting plates relative to the sheet-feeding direction, the upstream portions of the side walls being formed with projecting portions projecting upwardly from the sheet holding surface to a height exceeding the maximum height of the sheets stacked on the sheet holding surface so that the projecting portions prevent shifting of an upstream portion of the sheet in the sheet width direction, all portions of the side walls upstream and downstream of the projecting portions projecting up to a height from the sheet holding surface that is less than the maximum height of sheets that can be stacked on the sheet holding surface.

16. The sheet-feeding device according to claim 15, wherein areas of the side walls having the projecting portions are spaced more inwardly in the sheet width direction than portions of the side walls downstream of the projecting portions in the sheet-feeding direction.

17. The sheet-feeding device according to claim 16, wherein each of the projecting portions has a substantially trapezoidal shape.

* * * * *